US005655024A

United States Patent [19]

Bell et al.

[11] Patent Number: 5,655,024

[45] Date of Patent: Aug. 5, 1997

[54] METHOD OF TRACKING POSTAGE METER LOCATION

[75] Inventors: Easton F. Bell, Norwalk; Ian A. Siveyer, Trumbull, both of Conn.

[73] Assignee: Pitney Bowes Inc., Stamford, Conn.

[21] Appl. No.: 582,060

[22] Filed: Jan. 2, 1996

[51] Int. Cl.[6] ..... H04K 1/00

[52] U.S. Cl. ..... 380/51; 380/23

[58] Field of Search ..... 380/51, 23, 25

[56] References Cited

U.S. PATENT DOCUMENTS

| | | | |
|---|---|---|---|
| 5,181,245 | 1/1993 | Jones | 380/23 |
| 5,377,268 | 12/1994 | Hunter | 380/23 |
| 5,448,641 | 9/1995 | Pinstov | 380/51 |

*Primary Examiner*—Thomas H. Tarcza
*Assistant Examiner*—Carmen D. White
*Attorney, Agent, or Firm*—Angelo N. Chaclas; Charles G. Parks, Jr.; Melvin J. Scolnick

[57] ABSTRACT

The method provides for tracking a meter vault which is adapted for use in combination with a graphic interface unit. The graphic interface unit includes the graphics for the indicia town circle with an assigned area of origin code. The meter vault has an input keyboard for inputting additional information to the meter vault. The method involves the steps of storing the unique code of origin information in the non-volatile memory of the meter vault during initialization of the meter vault and in the graphic interface unit. During each power-up cycle of the meter vault request the unique code of origin from the graphic interface unit, A comparison of the received code of origin with the store code of origin is made. If the codes comparison is untrue, the meter locks requiring the manufacturer to issue an unlock code after verification of meter vault location.

3 Claims, 3 Drawing Sheets

METHOD OF TRACKING POSTAGE METER LOCATION

BACKGROUND OF THE INVENTION

The present invention relates to postage meter system which employs a postage meter for printing a postage indicia on each posting envelope and, more particularly, to procedures for identifying the location of the postage meter which is used to print an indicia on each posted envelope.

It is a procedure of the Postal Service to maintain funding records for each postage meter within the postal district wherein the postage meter is located. This procedure is one of a number of steps taken by the Postal Service to protect against fraudulent use of postage meters. As part of this procedure, the holder of a postage meter is provided by the manufacturer with the ability to print what is referred to as a "town circle" as part of the postage indicia. Also, as part of the postage indicia, there is printed a meter serial number. With the town circle and the serial number information, the branch post office can verify that source of the mailpiece.

Therefore, if a holder of a postage meter relocates the postage meter to a different post office branch, it is procedurally required that the holder register the relocation of that postage meter and that the meter be modified to reflect its relocation and thereby provide the postal service with a method of tracking the location of the postage meter.

SUMMARY OF THE INVENTION

It is an object of the present invention to present an improved method of tracking the location of a postage meter.

A postage meter system particularly suited with the present invention includes a base unit, more commonly referred to as a mailing machine, which serves as a platform for the meter unit. The base includes a microcontroller system which is responsible for controlling the transportation of envelopes in a sequential manner to a printing location whereat the printing unit can print an postage indicia including the town circle and any other additional information, such as, an ad slogan, delivery address or bar code on the envelope.

The meter unit is comprised of a vault and a keyboard display. The vault accounts for and dispenses funds for postal payment. The keyboard display is used principally to facilitate recharging the meter with funds. Communication between the mailing machine, vault and printer is facilitated through a printer interface unit. The meter vault communicates with the print head to transfer encrypted messages for postage amount, piece count, and digital tokens. A digital token represents an alphanumeric sequence generated by using any suitable algorithm which uniquely identifies the postage indicia as originating from a particular postage meter system and verifying that that postage meter system is authorized for use by the Postal Authorities. Meter vault communications are routed to the print head through the printer interface. The meter vault securely communicates with the print head using any suitable digital encryption technique.

The printer interface serves as a junction board for the mailing machine, meter vault, graphics interface box, and print head. This minimizes the number of connection points in the system. The printer interface provides the connections for a serial communication linkage and unregulated DC power from the mailing machine to the meter vault, transfers print command and status signals between the mailing machine and print head, interfaces the graphics interface box to the print head, supports a unique serial link between the meter vault and print head, and regulates logic and print nozzle power from the mailing machine to the print head.

The graphics interface box stores graphics images representing the fixed part of the standard indicia (e.g., the eagle printed on US mail), low-value indicia, permit mail indicia, town circle, inscriptions, and customer slogans. It also stores the fonts for printing the variable data on the mail piece. All of the graphics data is either encrypted or signed, i.e., subject to other types of encoding algorithms in the graphics interface box non-volatile memory. The encryption or signing is done at the manufactures facility. Only the print head contains the necessary decryption key to properly interpret the data.

When the meter is initially placed in service, it is required that a graphic interface box is attached. As part of that initiation process, the graphic interface box transmits a unique code assigned to that postal area town circle which is stored in the non-volatile memory of the vault in a secure location, Thereafter, each time the vault is powered-up, the town circle code is compared to the stored code. If those codes compare, then the meter is released to operate. If the codes do not match, the meter locks up and an unlock code from the manufacturer is required. In this manner the manufacturer is advised of the relocation of the meter vault pursuant to which the regional post office may be advised.

DETAILED DESCRIPTION OF THE PREFERRED EMBODIMENT

Figure 1:
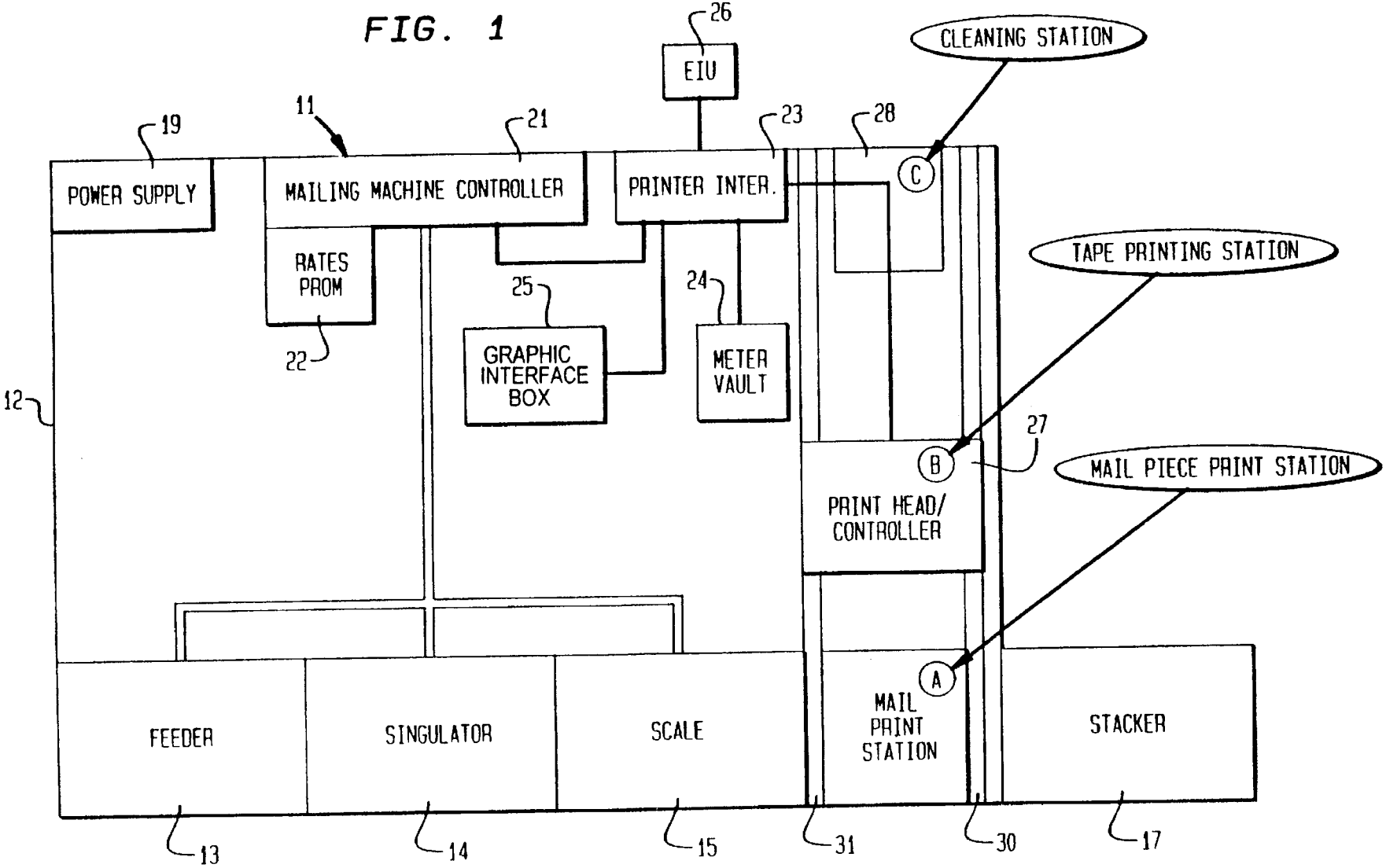
FIG. 1 is a schematic of a postage metering system in accordance with the present invention.

Referring to FIG. 1, the postage meter system, generally indicated as 11, includes a mailing machine base 12. The mailing machine base 12 is of any suitable conventional design and, in the preferred embodiment, includes a feeder section 13, singulator 14 and scale section 15 positioned serially along a mail flow path. Following the scale section 15 is a print station at location A which is followed by a stacker 17. Any suitably designed feeder section 13, singulator section 14, scale section 15 and stacker section 17 may be used. The operation of the respective section 13, 14, 15, and 17 is under the control of a mailing machine controller 21. Power to the system is provided by a conventional power supply 19. It should be appreciated that the mailing machine controller 21, in the preferred embodiment, will control such additional functional systems as the operator keyboard and display, unsecured departmental accounting (not shown) and other convention system functions. As depicted in FIG. 1, a rates programmable read only memory (PROM 22) is detachable mounted to the mailing machine controller 21 to provide rate information to the mailing machine controller in any suitable conventional manner.

Also, housed in the mailing machine is a printer interface 23, graphics interface box 25, meter vault 24 and print head/controller 27, hereafter referred to as print head 27. The print head 27 is mounted to a rails 30 and 31 by any suitable means to be positionable, by any convention means such as by a motor (not shown) between a first position "A" which is the print position, a second position "B" which is a tape print position, and a third position "C" which is a cleaning position. At position "C" the print head 27 is brought into contact with a nozzle cleaning system of any suitable design such that, for example, wherein ink jet print technology is utilized by the print head 27, the nozzles may by cleaned. The positioning of the print head 27 along the rails 30 and 31 is under the control of the mailing machine controller utilizing any suitable conventional control means.

Also, the mailing machine 12 includes provisions for allowing the external interface of an external interface unit (EIU 26) to the printer interface 23 by any conventional means. The EIU 26 provides additional microprocessing functionality and peripheral interfacing to the system 11 utilizing any suitable method.

Figure 2:
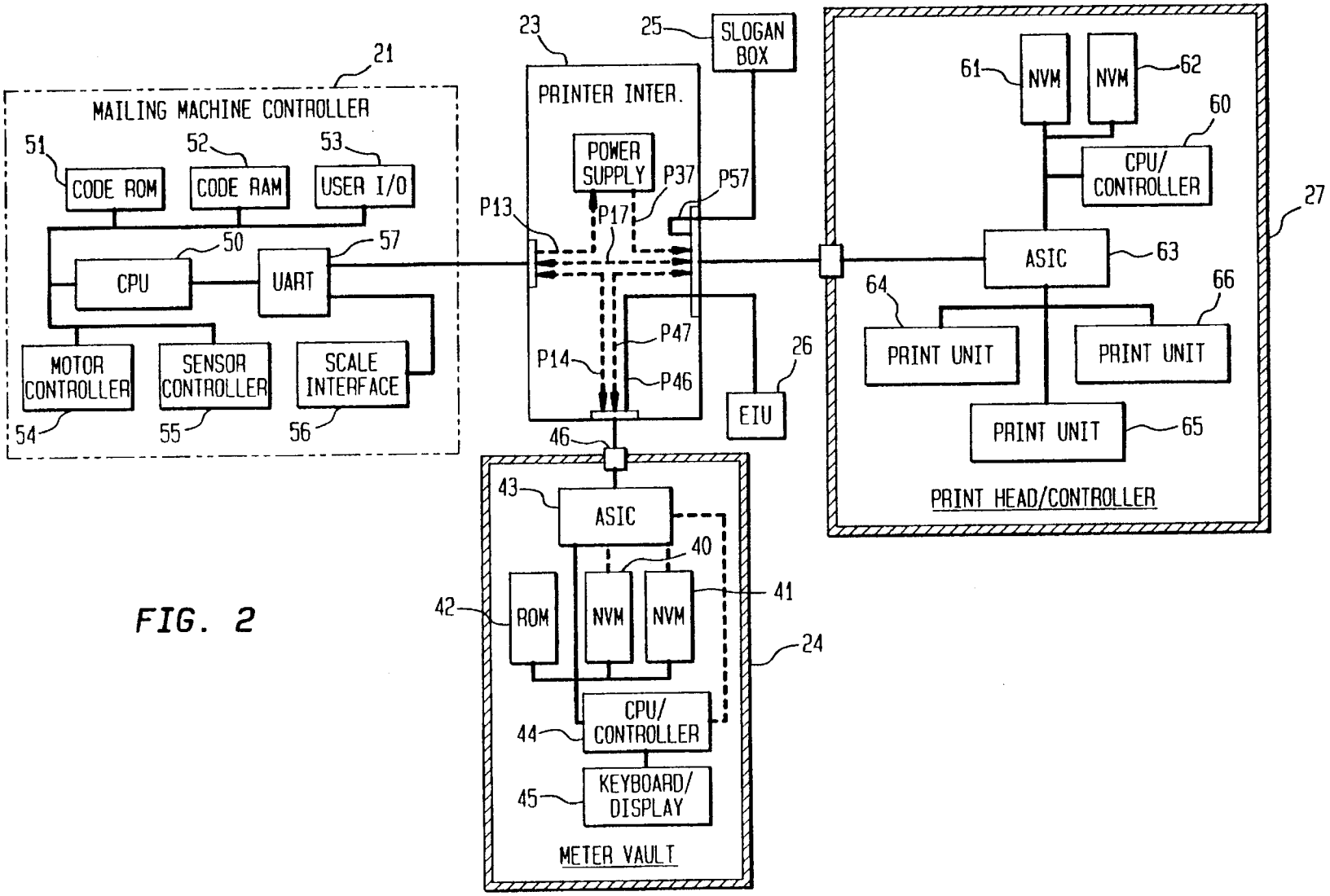
FIG. 2 is a schematic illustration of the communication path between the meter vault, mailing machine and print head units and of the respective control systems in accordance with the present invention.

Referring to FIG. 2, the meter vault 24 includes a funds accounting memory 40 and 41, program memory 42, ASIC 4, CPU controller 44, and keyboard/display 45. As more specifically described subsequently, the ASIC 43 provides two RS-232 communications ports 46 in any suitable conventional means for facilitating communications with the mailing machine 21 and the printhead 27.

The communication port 46 is modified to include an extra pin for receiving DC power from the mailing machine. It should be appreciated that the keyboard and display 45 is provided an operator or postal agent a means of recharging the accounting registers of the accounting memory 40 and 41 through the keyboard in any suitable conventional manner.

The mailing machine controller 21 is comprised of a controller CPU 50, code ROM 51, code RAM 52, user input/output 53, motor controller 54, sensor controller 55. Also provided is a scale interface 56 and UART interface 57. The UART interface 57 is of any conventional design for allowing asynchronous serial communication. Of principle concern to the preferred embodiment of the present invention is that the UART interface 57 facilities communication between the mailing machine controller 21 and the other system units 23, 24, 25, 26 and 27.

The print head 27 is comprised of a CPU controller 60, nonvolatile memory units 61 and 62, ASIC 63 and print units 64, 65, 66. In the preferred embodiment it is contemplated to use multiple ink jet printing units.

Meter vault 24 communications to the print head 27 are routed through the printer interface 23 along communication path P47. The meter vault 24 securely communicates with the print head 27 using DES encryption. A number of encryption keys are preloaded into the ASIC's 63 of the print head 27 and ASIC 43 of the meter vault 24. This will make discovering the keys impossible without reverse engineering of the ASIC's 43 or 63. Communications path 47 is also used to select inscriptions and slogans in conjunction with the graphics interface box 25. A printer interface path P46 provided for electrical communication with the EIU 26. As aforenoted, the EIU 26 represents an external unit which can be attached to the meter vault 24 to provide enhanced capability to the meter vault 24.

The printer interface 23 serves as a junction board for the mailing machine 21, meter vault 24, print head 27 and a graphics interface box 25. By providing specific communication path P13, P14, P17, P37, P46, P47, P57 within the printer interface 23, the individual subsystems can be isolated in such a manner to remove the necessity for interdependent security measures.

The graphics interface box 25 stores graphics images representing the fixed part of the standard indicia (e.g., the eagle printed on US mail), low-value indicia, permit mail indicia, town circle, inscriptions, and slogans. It also stores the fonts for printing the variable data on the mail piece. All of the graphics data is either encrypted or signed in the graphics interface box 25 non-volatile memory (not shown). Only the print head 15 contains the necessary decryption key to properly interpret the data. Because of the different indicia formats, each country will have its own indicia graphics, therefore its own graphics interface box 25 product code number.

When a new print head 27 is positioned or installed in the mailing machine 17, the controller 27 checks the local NVM 61 and 62; if it is uninitialized, the controller reads the graphics interface box to retrieve the necessary graphics information. The print head decrypts or verifies this data and programs it into its NVM 61 and 62. In the event that the print head NVM 61 and 62 are smaller than the slogan box NVM, only the subset of graphics necessary for a particular mail run is loaded into the print head NVM 61 and 62. If the NVM 61 and 62 should become corrupted, e.g., fails a checksum test, the controller 60 can request a new memory download as though it were newly installed.

When the mailing machine 21 initiates the meter ad selection option as a result of operator selection via the user I/O 53, the graphics interface box 25 will transfer a text description of each of its slogans to the mailing machine 21 through the print head 27 and meter vault 24. Once the operator responds with the selected slogan to print by selection of the appropriate operator key on the mailing machine 21, the graphics interface box 25 transfers the bit-map slogan image to the print head 27 if it is not already loaded in the print head NVM 61 and 62. The graphics interface box 25 electrically connects to the print head 27.

The print head 27 prints the indicia including postage amount, digital tokens, piece count, and date as well as an optional inscription and slogan on each mail piece. The fixed part of the image, fonts for the variable parts of the image, and inscription bit-maps are programmed into the print head's NVM 61 and 62 when the print head is first installed in the mailing machine 17. The meter vault 24 will send a message to the print head indicating the format of the town circle. The print head obtains the town circle information as either a text string from the meter vault or a bit map from the graphics interface box and programs its NVM with the data. For each mail piece, the meter vault 24 transfers the variable indicia information such as the postage amount, digital tokens, meter serial number, and piece count to the print head. The print head controller 60 programs registers (not shown) in the ASIC 63 with this information. When the mailing machine 21 commands the print head to print, the ASIC 63 combines the fixed and variable parts of the image for printing by the print units 64, 65 and 66 utilizing any suitable technique.

The interface with the meter vault 24 includes encrypted information; only the meter vault 24 and the print head 27 know the proper keys to utilize the information. The keys are stored in an ASIC 63 on the print head 27 and the meter vault ASIC 43.

The controller 60 on the print head controls the printing operation including loading of NVM 61 and 62, decoding of messages and initiating of printing.

The print head ASIC 63 also decodes the mail position for printer sequencing, provides the proper timing for driving the print nozzles, supports external ink supply monitoring, interfaces to the NVM 61 and 62; supports external communications, and performs self-test functions. The print head NVM 61 and 62 also stores inscription representations. The meter vault 24 stores a table of enabled inscriptions. When the operator at the mailing machine 21 wishes to select an inscription, the print head transfers a list of the available options to the meter vault. The vault screens for only the enabled inscriptions and sends the information to the mailing machine 21. The operator response is forwarded from the meter vault 24 to the print head 27.

Figure 3:
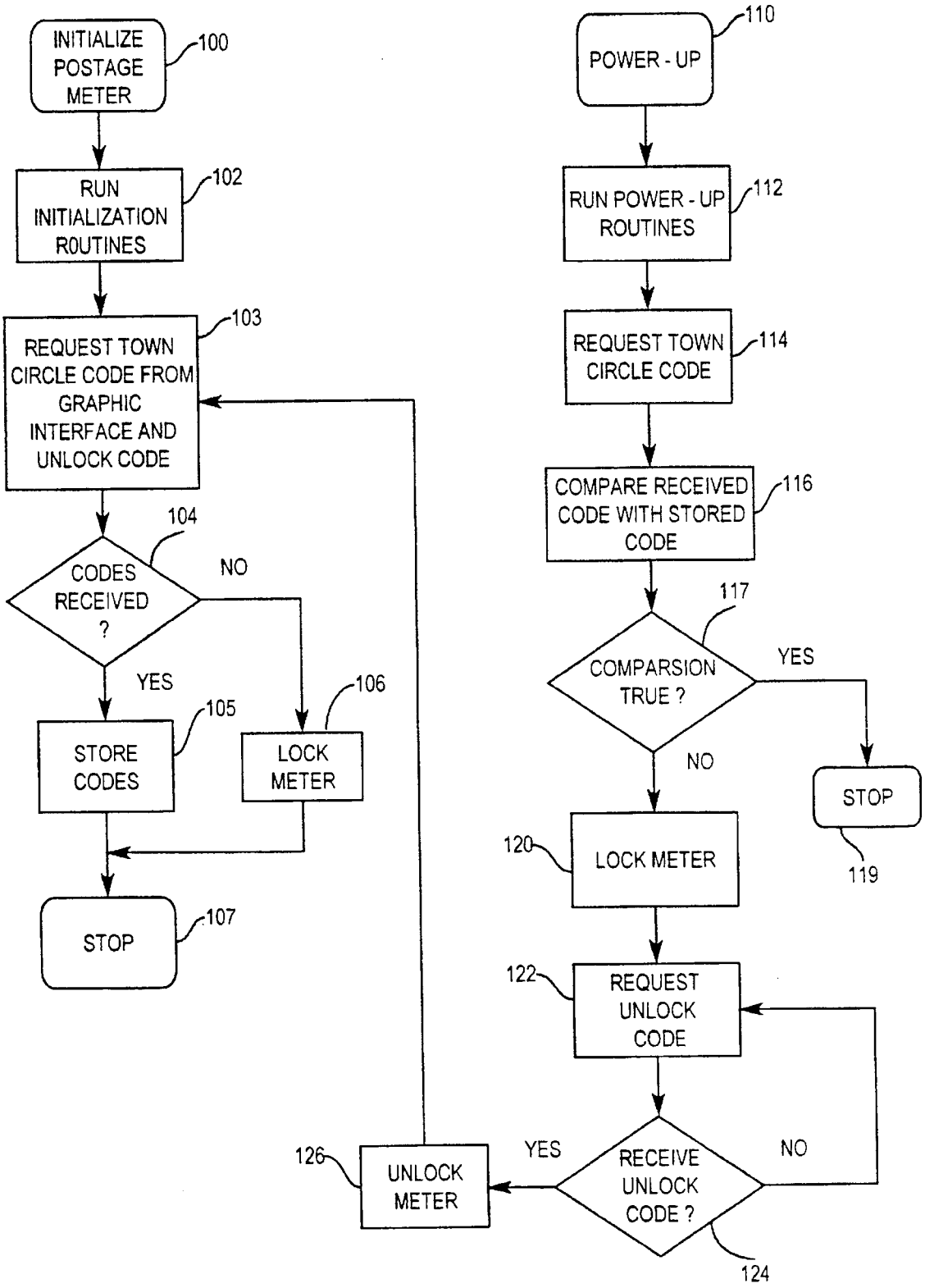
FIG. 3 is a logic flow diagram for meter verification of town circle data.

Referring now to FIG. 3, when the vault 24 is placed in operation an initialization process is initiated at logic step 100. The initialization routines are executed at logic step 102. Following the completion of the initialization routines, the vault request the town circle code for the postal region where that vault will be initially located and a unlock code at logic step 103. At logic step 104, ones the codes are received they are stored in the non-volatile memories of the vault 24 and the routine ends at logic step 107. If the codes are not received, the meter locks at logic step 106 and a special manufacturing procedure must be executed in order to then unlock the meter. It should be appreciated that the code may be specially formatted to facilitate protection from stolen meter vaults from being placed in service fraudulently.

When the vault is powered-up at logic 110, the conventional power-up routines are executed at 112. A request is made by the meter vault 24 for the town circle code at 114. When that code is received, it is compared with the stored code at logic step 114. If that comparison is true the routine ends at logic step 119. If that comparison is untrue, as would be the case wherein a new town circle had been issued by the manufacturer, then the meter vault locks at logic step 120. The meter vault 24 request an unlock code at logic step 122. At logic step 124, when a valid unlock code is received at logic step 124, the meter then unlocks at logic block 126. At this point the meter requests the new town circle code from the graphic interface and new unlock code at 103. The meter vault 24 then proceeds as above described to store the codes at logic block 105. The system can then be powered-up again with the new codes.

It should be appreciated that a customer in possession must acquire the unlock code from the manufacturer in order to unlock the meter vault and thereby informing the manufacturer of the meter location. Further, as noted before the necessary codes may be encrypted thereby preventing the customer from unlocking the meter vault without informing the manufacturer.

What is claimed is:

1. A method of tracking a meter vault adopted for use in combination with a graphic interface unit including area of origin information, said meter vault having an input means for allowing additional information input, non-volatile memory, comparator means and locking means, comprising the steps of:

(a) assigning a unique code to said area of origin information, (b) storing said unique code of origin information in said non-volatile memory of said meter vault during initialization of said meter vault and in said graphic interface unit, (c) requesting said unique code of origin from said graphic interface unit during each power-up cycle of said meter vault, (d) receiving and comparing said unique code of origin with said store code of origin, (e) locking said meter vault if said codes comparison is untrue.

2. A method as claimed in claim 1 further comprising the steps of:

(f) storing a unlock code in said meter vault, (g) inputting an unlock code into said meter vault by said input means, (h) comparing said unlock code stored in said meter vault with said unlock code input by said input means, (j) unlocking said meter vault only if said unlock codes match.

3. A method as claimed in claim 2 wherein said meter vault has decrypting means wherein said unlock code is encrypted and said decrypting means decrypts said unlocked code before comparing.

* * * * *